US008403317B2

(12) United States Patent
Matsuda

(10) Patent No.: US 8,403,317 B2
(45) Date of Patent: Mar. 26, 2013

(54) SHEET CONVEYANCE DEVICE AND IMAGE FORMING APPARATUS EMPLOYING SAME

(75) Inventor: Hiromichi Matsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/316,881

(22) Filed: Dec. 12, 2011

(65) Prior Publication Data

US 2012/0169006 A1 Jul. 5, 2012

(30) Foreign Application Priority Data

Jan. 5, 2011 (JP) ..... 2011-000505

(51) Int. Cl.
*B65H 5/22* (2006.01)

(52) U.S. Cl. ..... 271/3.19; 271/245; 271/246; 271/303

(58) Field of Classification Search ..... 271/3.19, 271/245, 246, 303
See application file for complete search history.

(56) References Cited

U.S. PATENT DOCUMENTS 3,815,897 A * 6/1974 Hoehl et al. ..... 271/9.13
4,431,322 A * 2/1984 Nally et al. ..... 400/605

FOREIGN PATENT DOCUMENTS

JP 62-276574 12/1987
JP 2006-282349 10/2006
JP 2008-24507 2/2008

* cited by examiner

*Primary Examiner* — David H Bollinger
(74) *Attorney, Agent, or Firm* — Oblon, Spivak, McClelland, Maier & Neustadt, L.L.P.

(57) ABSTRACT

A sheet conveyance device comprises first and second sheet parallel conveyance paths each having first and second conveyance roller units each to receive and convey a sheet and first and second skew correctors each to correct skew of a sheet therein. A third conveyance path is disposed downstream of the first sheet conveyance path and the second sheet conveyance path, in which those sheet conveyance paths flow into each other. The sheet conveyance device alternately conveys the sheet to first sheet conveyance path and the second sheet conveyance path. One of the first pair of sheet conveyance rollers is one of the second pair of sheet conveyance rollers as a common roller.

20 Claims, 8 Drawing Sheets

SHEET CONVEYANCE DEVICE AND IMAGE FORMING APPARATUS EMPLOYING SAME

CROSS-REFERENCE TO RELATED APPLICATIONS

This patent application is based on and claims priority pursuant to 35 U.S.C. §119 to Japanese Patent Application No. 2011-000505, filed on Jan. 5, 2011, in the Japan Patent Office, the entire disclosure of which is hereby incorporated by reference herein.

FIELD OF THE INVENTION

The present disclosure relates to a sheet conveyance device and an image forming apparatus including the same.

BACKGROUND OF THE INVENTION

It is known that a sheet conveyance device launches and conveys sheets one by one from a sheet stacking unit that stacks multiple sheets thereon to a skew correction mechanism disposed on a conveyance path to correct skew and further convey the sheet to a prescribed position. Such a skew correction mechanism is generally composed of a pair of registration rollers serving and a pair of conveyance rollers disposed upstream of the pair of registration rollers. The sheet conveyed to the skew correction mechanism is conveyed by the pair of conveyance rollers toward the pair of registration rollers, which stops rotating, so that a leading end thereof abuts a nip formed between the pair of registration rollers. Hence, by continuously driving and bending the sheet with the conveyance rollers after the leading end abuts the nip, skew of the sheet is corrected.

In the conventional sheet conveyance device, the pair of registration rollers stops rotating when the trailing end of the sheet exits therefrom. The leading end of a subsequent sheet then abuts the nip and skew thereof is similarly corrected, after which the sheet is further conveyed. Accordingly, a certain interval between successive sheets must be maintained in order for this arrangement to function as intended, and therefore there is a limit to how much this interval can be shortened after skew correction.

To solve the above-described problem, Japanese Patent No. 2611199 (JP-2611199-B) employs a sheet conveyance device including two sheet conveyance paths each including the above-described skew correction mechanism. In such a system, a sheet is alternately conveyed to the first and second sheet conveyance paths from a sheet stacking unit, so that skew of the sheet is corrected by the first or second sheet conveyance path and is further conveyed toward a third conveyance path.

Hence, since these sheet conveyance paths having the skew correction mechanisms, respectively, are included, a subsequent sheet can be conveyed and the skew thereof is corrected in one of the sheet conveyance paths when the preceding sheet with its skew already corrected is conveyed along the other one of the sheet conveyance paths toward the third conveyance path. Hence, when the trailing end of the preceding sheet exits a pair of registration rollers provided on one of the sheet conveyance paths, skew correction of a subsequent sheet has been completed on the other one of sheet conveyance paths. Accordingly, when the trailing end of the preceding sheet exits the pair of registration rollers on one of the sheet conveyance paths, a subsequent sheet is ready for conveyance toward the third conveyance path. As a result, the interval between successively conveyed sheets can be more minimized after skew correction in comparison with a sheet conveyance device only having a single conveyance path with a skew correction mechanism.

However, according to the sheet conveyance device of JP-2611199-B, since there exist the pair of registration rollers and the sheet conveyance rollers in each of the first and second sheet conveyance paths, a large space is need for these sheet conveyance paths.

BRIEF SUMMARY OF THE INVENTION

Accordingly, the present invention provides a novel sheet conveyance device that comprises a first sheet conveyance path having a first pair of sheet conveyance rollers to receive and convey a sheet and a first skew corrector to correct skew of a sheet therein. The sheet conveyance device also comprises a second sheet conveyance path disposed parallel to the first sheet conveyance path having a second pair of sheet conveyance rollers to receive and convey a sheet and a second skew corrector to correct skew of a sheet therein. A third conveyance path is included and is disposed downstream of the first and second sheet conveyance paths, in which those sheet conveyance paths flow into each other. The sheet conveyance device alternately conveys the sheet to first and second sheet conveyance paths. One of the first pair of sheet conveyance rollers is one of the second pair of sheet conveyance rollers as a common roller.

In another aspect, each of the first and second pairs of sheet conveyance rollers is composed of driving and driven rollers, and the driven roller is the common roller.

In yet another aspect, each of the first skew corrector and the second skew corrector includes a bumper against which a leading end of a conveyed sheet bumps. A pair of registration rollers disposed upstream of the bumper in the sheet conveyance direction conveys a skew corrected sheet to the third conveyance path, and a pair of pushing rollers pushes the sheet after the sheet bumps into the bumper. One of the pair of registration rollers or one of the pushing rollers in the first and second conveyance paths is the common roller.

In yet another aspect, one of the pair of registration rollers and one of the pair of the pushing rollers in the first and second conveyance paths are the common rollers.

In yet another aspect, the common roller separates from the other rollers than the common roller of the pair of conveyance rollers in the respective sheet conveyance paths. The common roller is ordinarily positioned at an intermediate position not to contact the other rollers in the respective sheet conveyance paths and contact the other roller sandwiching the sheet therewith when a leading end of the sheet passes through the other roller.

In yet another aspect, a pair of upstream conveyance rollers is disposed upstream of the pair of pushing rollers in the sheet conveyance direction. A pair of downstream conveyance rollers is disposed downstream of the pair of registration rollers in the sheet conveyance direction. One of the pair of registration rollers and that of conveyance rollers are the common rollers in the respective sheet conveyance paths. The common roller of the pair of pushing rollers contacts the other roller of the pair of pushing rollers sandwiching the sheet therebetween before a trailing end the sheet exits from the pair of upstream conveyance rollers. The common roller of pair of registration rollers contacts the other roller thereof sandwiching the sheet therebetween after the leading end the sheet conveyed by the pair of conveyance rollers abuts and stops at the bumper. The common roller of the pair of pushing rollers separates from the other roller thereof and moves to the intermediate position when the common roller of pair of registration rollers has contacted the other roller thereof sandwiching the sheet therebetween. The common roller of the pair of registration rollers separates from the other roller thereof and moves to the intermediate position when the sheet is conveyed by the pair of downstream conveyance rollers.

In yet another aspect, the first skew corrector is the second skew corrector.

In yet another aspect, a bumper moving device is provided to move the bumper between the first and second sheet conveyance paths. The bumper moving device is composed of an eccentric cam.

In yet another aspect, a pair of registration rollers serves as each of the first skew corrector and the second skew corrector and conveys a skew corrected sheet to the third conveyance path. A pair of pushing rollers pushes the sheet bumping into the pair of registration rollers. One of the pair of registration rollers and that of the pair of conveyance rollers is the common roller in the first and second sheet conveyance paths.

In yet another aspect, one of the pair of registration rollers is one of the pair of conveyance rollers as the common roller.

In yet another aspect, one of the pair of conveyance rollers is the common roller and freely separates the other roller of the pair of conveyance rollers disposed in each of the first and second conveyance paths. The common roller of the pair of pushing rollers is ordinarily positioned at an intermediate position not to contact the other roller of the pair of pushing rollers in each of the first and second conveyance paths, and contacts the other rollers sandwiching the sheet therewith when the leading end of the sheet passes through the other roller. The common roller of the pair of pushing rollers is moved to the intermediate position from the position in contact with the other roller of the pair of conveyance rollers when the pair of registration rollers starts conveying the sheet.

In yet another aspect, a downstream sheet conveyance path is disposed right downstream of the pair of registration rollers. One of the pair of registration rollers is the common roller and freely separates from the other roller of the pair of registration rollers in each of the first and second conveyance paths. The common roller of the pair of registration rollers is moved to contact the other roller of the pair of registration rollers in one of the first and second sheet conveyance paths from the position in contact with the other roller of the pair of registration roller to the other one of the first and second sheet conveyance paths when the downstream sheet conveyance path starts conveying the sheet.

In yet another aspect, a common roller moving device is provided to move the common roller between the first and second sheet conveyance paths. The common roller moving device is composed of an eccentric cam mechanism.

In yet another aspect, a common roller moving device is provided to move the common roller between the first and second sheet conveyance paths. The common roller moving device is composed of an eccentric cam mechanism.

In yet another aspect, the eccentric cam of the bumper moving device and that of the common roller moving device include the same curvature in a prescribed angular range and are secured to the same shaft with a difference phase angle from the other in a rotational direction.

In yet another aspect, a confluence sheet conveyance device is disposed on the third conveyance path. A detector is disposed in the vicinity of the confluence sheet conveyance device to detect a leading end of the sheet. A deviation correcting device is provided to correct deviation of a sheet arriving time from a prescribed reference time by controlling the confluence sheet conveyance device in accordance with deviation in a sheet arriving time detected thereby.

In yet another aspect, a lateral deviation detector is provided to detect positional deviation in the sheet in a direction perpendicular to a sheet conveyance direction. A movable sheet conveyance device is movably provided in a direction perpendicular to a sheet conveyance direction parallel to a plane of the sheet. A position adjuster is provided to move the sheet in a direction perpendicular to a sheet conveyance direction to adjust a position of the sheet in the direction in accordance with a detection result of the lateral deviation detector.

In yet another aspect, the movable sheet conveyance device is composed of the pair of registration rollers that convey the sheet with the skew being corrected by one of the first skew corrector and the second skew corrector toward the third conveyance path.

In yet another aspect, multiple confluence sheet conveyance devices are disposed on the third conveyance path. A guide is provided to guide the sheet conveyed from one of the first and second sheet conveyance paths so that the first and second sheet conveyance paths flow into each other at upstream of the uppermost stream confluence sheet conveyance device. The position detector is located between the confluence in which the sheets meet with each other and the uppermost stream confluence sheet conveyance device.

In yet another aspect, an image formation apparatus comprises an image bearer, an image formation device that forms a visual image on the image bearer, and the sheet conveyance device that conveys a sheet. A transfer device is provided to transfer the visual image from the image bearer to a sheet conveyed by the sheet conveyance device.

In yet another aspect, the first and second sheet conveyance paths flow into each other at upstream of the transfer device in the sheet conveyance direction.

BRIEF DESCRIPTION OF THE DRAWINGS

A more complete appreciation of the present invention and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
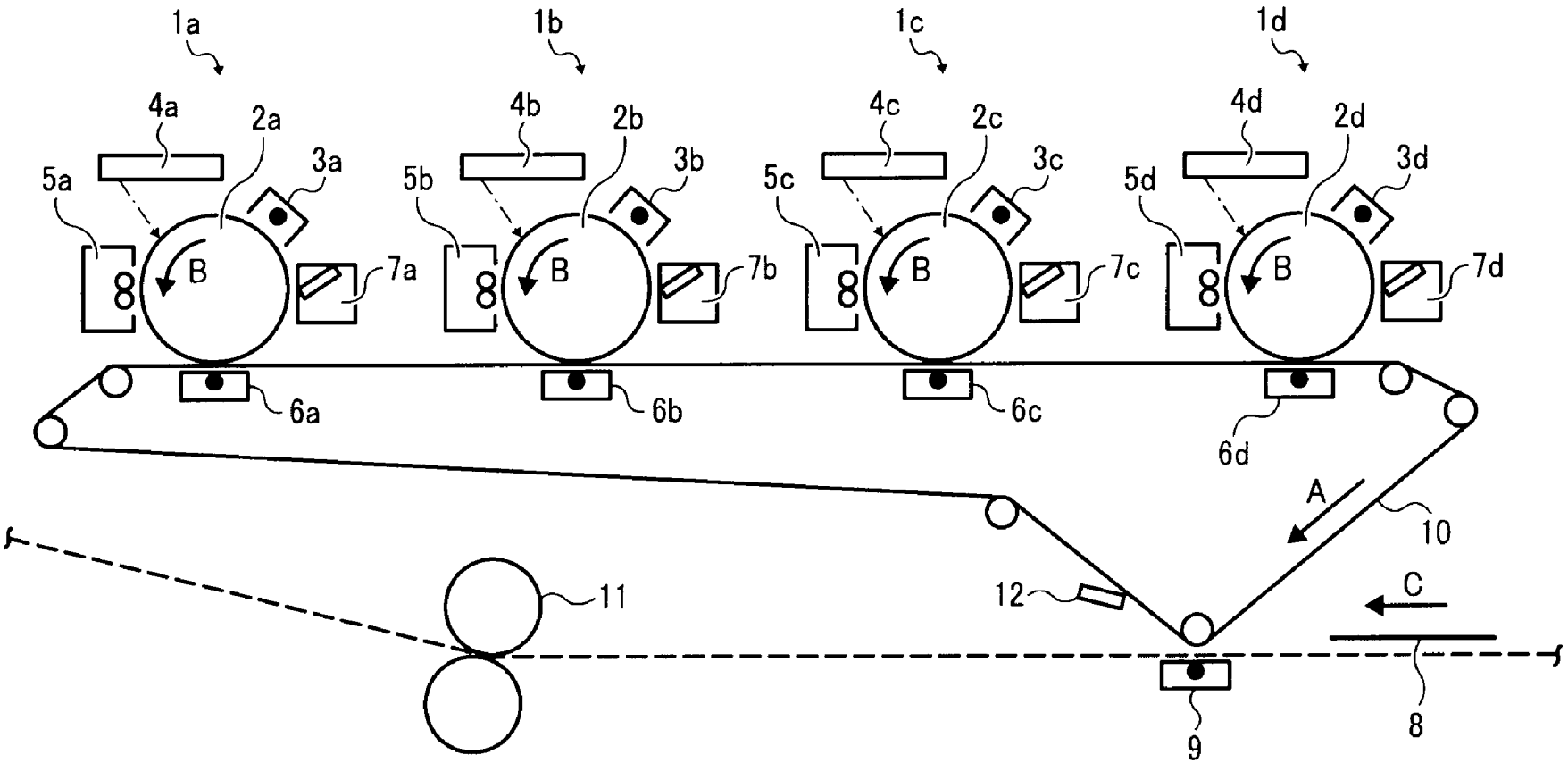
FIG. 1 schematically illustrates an essential part of a printer according to one embodiment of the present invention.

Referring now to the drawings, wherein like reference numerals designate identical or corresponding parts throughout the several views thereof, and in particular to FIG. 1, a printer as an image formation apparatus employing a tandem-type intermediate transfer system according to one embodiment is described. Initially, an essential part of the printer is described with reference to FIG. 1.

The printer includes four image formation units 1*a*, 1*b*, 1*c*, and 1*d* disposed along a running direction of a transfer belt 10. The image formation units 1*a* is composed of a photoconductive drum 12*a* as an image bearer, a drum charger 3*a*, an exposure device 4*a*, a developing device 5*a*, a transfer device 6*a*, and a cleaner 7*a* or the like. The remaining image formation units 1*b*, 1*c*, and 1*d* have the similar configurations as the image formation unit 1*a*, and their configurations and operations are not described. The image formation units 1*a*, 1*b*, 1*c*, and 1*d* form yellow to black color images, respectively.

Upon receiving a start instruction signal instructing start of image formation from a printer apparatus controller, not shown, the photoconductive drum 2*a* starts and continues rotating in a direction as shown by an arrow B in the drawing rotation until the end of the image formation. When the drum 2*a* starts rotating, a high voltage is applied to the charger 3*a* to uniformly charge a surface of the photoconductive drum 2*a* with negative electric charge. Subsequently, when the printer receives character or drawing data converted into a dot image as a turn on/off signal for the exposure device 4*a* from the printer apparatus controller, not shown, the photoconductive drum 2*a* becomes to have a portion exposed to a laser light emitted from the exposure device 4*a* and that not exposed thereto on the surface thereof. When opposed to the developing device 5*a*, the portion having decreased electric charge due to the exposure to the laser light attracts toner having a negative charge, thereby forming a toner image thereon.

When the toner image on the photoconductive drum 2*a* reaches the transfer device 6*a* serving as a primary transfer device, the toner image is transferred onto a transfer belt 10 rotating in the direction as shown by an arrow A in the drawing under influence of a high voltage applied to the transfer device 6*a*. Residual toner not transferred from the photoconductive drum 2*a* is removed even after passing through the transfer position (i.e., an image transfer portion) by a cleaner 7*a* to prepare for the next image formation. Subsequent to the above-described operations of the image formation unit 1*a*, the image formation unit 1*b* also executes similar image formation. Specifically, a toner image on the photoconductive drum 2*b* is transferred onto the transfer belt 10 under influence of a high voltage applied to the transfer charger 6*b*. At that moment, a time when an image formed by the image formation unit 1*a* and transferred onto the transfer belt 10 reaches the transfer device 6*b* is equalized with a time when a toner image formed on the photoconductive drum 2*b* is transferred onto the transfer belt 10. Consequently, these toner images formed in the respective image formation units 1*a* and 1*b* are superposed on the transfer belt 10. Similarly, by additionally superposing toner images formed by the image formation units 1*c* and 1*d* on the transfer belt 10, a full-color image is formed and transferred onto the transfer belt 10.

At the same time when the full-color image reaches a sheet transfer device 9 serving as a secondary transfer device, a sheet conveyed from a sheet feeding unit, not shown, of the image formation apparatus in a direction as shown by an arrow C in the drawing reaches the sheet transfer device 9. Accordingly, the full-color image on the transfer belt 10 is transferred onto the sheet 8 under influence of a high voltage applied to the sheet transfer device 9. When conveyed into a fixing device 11, the toner image on the sheet 8 is fused and fixed thereonto by the fixing device 11. Further, residual toner remaining on the transfer belt 10 is removed by a belt cleaning mechanism 12 therefrom after passing through the full-color image.

Figure 2A:
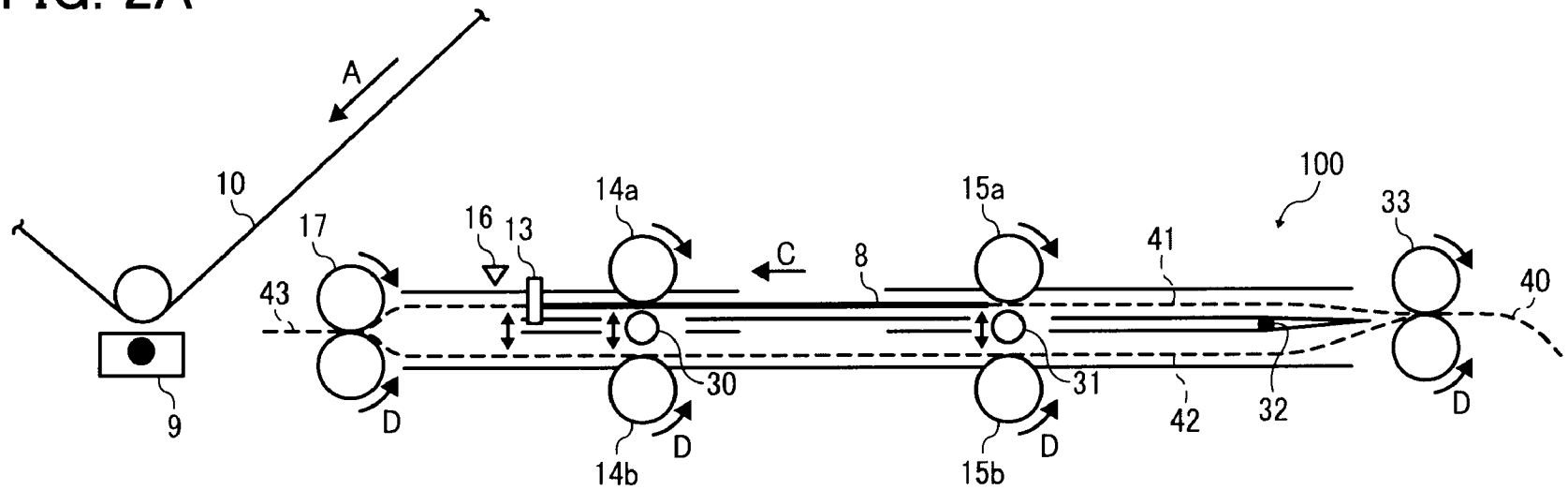
FIGS. 2A and 2B collectively schematically illustrate a configuration of a sheet conveyance device according to one embodiment of the present invention.
Figure 2B:
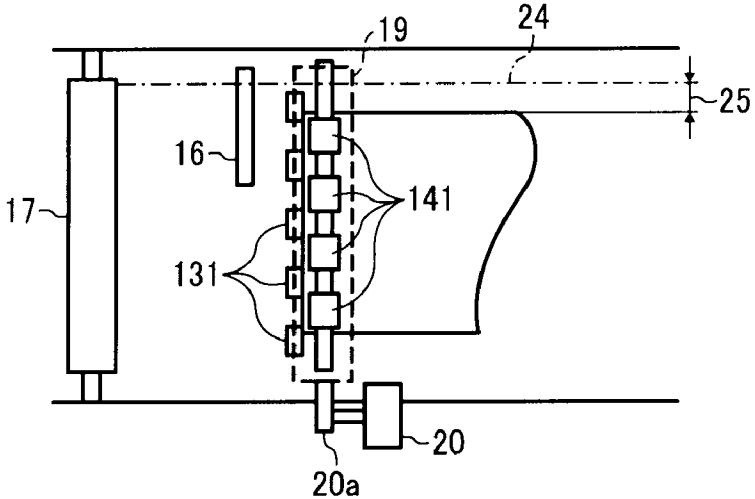

Now, a sheet conveyance device disposed upstream of the sheet transfer device 9 in the sheet conveyance direction is described as one of features of the printer with reference to FIGS. 2A and 2B. As shown, FIG. 2A is a side view of the sheet conveyance device 100, and FIG. 2B is a plan view illustrating surroundings of a registration roller 14*a* of a first sheet conveyance path. The sheet conveyance device of this embodiment includes a sheet feeding path 40 that conveys a sheet fed from a sheet feeding mechanism, not shown, first and second sheet conveyance paths 41 and 42 disposed parallel to each other having skew correction mechanisms, respectively, and a third conveyance path 43 in which the first and second sheet conveyance paths 41 and 42 merge with each other.

In the sheet feeding path 40, there is provided a pair of conveyance rollers 33 to convey a sheet either to the first or second sheet conveyance path 41 or 42. At a bifurcation point of (between) the first and second sheet conveyance paths 41 and 42, a separation pick 32 is provided to guide the sheet either to the first or second sheet conveyance paths 41 or 42.

The first and second sheet conveyance paths 41 and 42 include the skew correction mechanisms, respectively, as described. The skew correction mechanism includes a gate 13 serving as a bumper unit for positioning a leading end of the sheet 8 when the sheet is conveyed and bumps thereinto, a pair of registration rollers disposed upstream and in the vicinity of the gate 13 in the sheet conveyance device to convey the sheet with its skew being corrected toward the third conveyance path 43, and a pair of pushing rollers disposed upstream of the pair of registration rollers to continuously convey and push the sheet after the sheet abuts the gate 13.

As shown in FIG. 2B, the gate includes multiple bumping portions 131 aligned in a main scanning direction (i.e., up and down direction in FIG. 2B) at the same interval. The gate also includes a moving mechanism as a moving device moving the gate between the first and second sheet conveyance paths 41 and 42 in a direction as shown by an arrow in FIG. 2A, so that the gate is commonly used both in the first and second sheet conveyance paths 41 and 42. Further, the first pair of registration rollers provided in the first sheet conveyance path 41 are composed of the first registration roller 14*a* as a pushing roller driven by a driving motor, not shown, as a driving source and a first pressing roller 30 as a driven roller contacting and driven by the first registration roller 14*a*. Further, the first pair of pushing rollers provided in the first sheet conveyance path 41 are composed of a first conveyance roller 15*a* as a pushing roller driven by a driving motor, not shown, as a driving source, and a second pressing roller 31 as a driven roller contacting and driven by the first conveyance roller 15*a*. Further, as shown 2B, the first registration roller 14*a* includes multiple roller elements 141 supported around a rotary shaft at the same interval.

Further, the second pair of registration rollers provided in second sheet conveyance path 42 are composed of a second registration roller 14*b* as a pushing roller driven by the driving motor, not shown, commonly used as a driving source by the first registration roller 14*a* and a first pressing roller 30. Specifically, the second registration roller 14*b* is opposed to the first registration roller 14*a* via the first pressing roller 30. The first pressing roller 30 is vertically movable in a direction as shown by an arrow in FIG. 2A and is moved by a driving device, not shown, to either contact or separate from the first and second registration rollers 14*a* and 14*b*. Specifically, the first pressing roller 30 is a common roller commonly used in pairs of first and second registration rollers as described later more in detail. The second registration roller 14*b* has the substantially the same configuration as the first registration roller 14*a*.

Further, the second pair of pushing rollers provided in second sheet conveyance path 42 are composed of a second conveyance roller 15*b* as a pushing roller driven by the driving motor, not shown, commonly used as a driving source by the first conveyance roller 15*a* and a second pressing roller 31. Specifically, the second conveyance roller 15*b* is opposed to the conveyance roller 15*a* via the second pressing roller 31. The second pressing roller 31 is vertically movable in a direction as shown by an arrow in the drawing and is moved by a driving device, not shown, to either contact or separate from the first and second conveyance rollers 15*a* and 15*b*. Specifically, the second pressing roller 31 is a common roller commonly used as both of the first and second pairs of pushing rollers.

Hence, by commonly using one of the pair of first and second registration and pushing rollers as common rollers both in the first and second sheet conveyance paths, an interval between the first and second sheet conveyance paths arranged parallel can be minimized (i.e., flattened). Further, a space to be occupied by the sheet conveyance device 100 in the image formation apparatus can be minimized thereby capable of downsizing the image formation apparatus.

Further, the first and second pressing rollers 30 and 31 serving as common rollers have sufficiently small diameters than that of rollers of contact objectives (i.e., registration rollers 14*a* and 14*b*, and conveyance rollers 15*a* and 15*b*), respectively. Accordingly, by decreasing the diameters of the first and second pressing rollers 30 and 31, the interval between the first and second sheet conveyance paths arranged parallel can be further minimized.

Further, in the vicinity of downstream of the gate 13, there is provided a sheet detection sensor 16 that partially detects one end of a sheet traveling both the first and second sheet conveyance paths 42 in the main scanning direction. As the sheet detection sensor 16, a line type CCD or the same type CIS and the like as used in a scanner can be employed. Among those, since having a great detection depth even with a large size, the line type CCD is most preferably employed to detect an end of a sheet on the first and second sheet conveyance paths 42.

Further, there is provided a pair of timing rollers 17 at downstream of the sheet detection sensor 16 to convey a sheet to a sheet transfer device 9 at a prescribed time. For example, the first and second conveyance paths 41 and 42 flow into each other at a nip between the pair of timing rollers 17.

Even not shown in FIG. 2B, there are mounted on a unit frame 19 (shown by a dotted line in the drawing) the first and second registration rollers 14*a* and 14*b*, a registration roller rotation driving mechanism for rotating these rollers, the first pressing roller 30, and a contact and separate moving mechanism for contacting and separating the first pressing roller 30. The registration roller rotating and driving mechanism includes a registration driving motor for rotating and driving the registration rollers 14*a* and 14*b*, and a transmission mechanism, such as a gear, a clutch, etc., for transmitting a driving force from the registration driving motor to the driving the registration rollers 14*a* and 14*b*. The contact and separation movement mechanism includes a contact and separation motor used for contacting and separating the first pressing roller 30, and an eccentric cam for contacting and separating the first pressing roller 30 as described later in detail. The unit frame 19 is movable in a main scanning direction (i.e., an up and down direction in FIG. 2B), and is moved by a main scanning direction movement motor 20 in the direction. Specifically, the unit frame 19 engages a cam 20*a* secured to a driving shaft of the main scanning direction movement motor 20. More specifically, an engage groove is formed in the vicinity of an outer circumference of the cam 20*a*, in which an engaging objective disposed on the unit frame 19 fits. A stepping motor is employed in the main scanning direction movement motor 20.

A controller as a positional adjuster, not shown, calculates a sheet deviation amount 25 corresponding to a distance from a reference conveyance line 24 to one end of a sheet in a main scanning direction (i.e., lateral direction of the sheet) as shown 2B based on a detection result of a sheet detection sensor 16. Subsequently, when main scanning direction movement motor 20 and accordingly the cam 20*a* rotates, the engagement objective, not shown, included in the unit frame 19 relatively moves in the engaging groove, not shown, of the cam 20*a*, so that the unit frame 19 moves in the main scanning direction. Consequently, the sheet conveyed by the pair of registration rollers as a movable sheet conveyance device shifts in the main scanning direction and one end of the sheet in the main scanning direction is aligned to the reference conveyance line 24, so that a positional deviation of the sheet in the main scanning direction can be corrected.

Now, the contact and separation mechanism 200 of the first pressing roller 30 is described with reference to FIG. 3. Since the second pressing roller 31 employs the similar contact and separation mechanism as described above, description thereof is not repeated here.

Figure 3A:
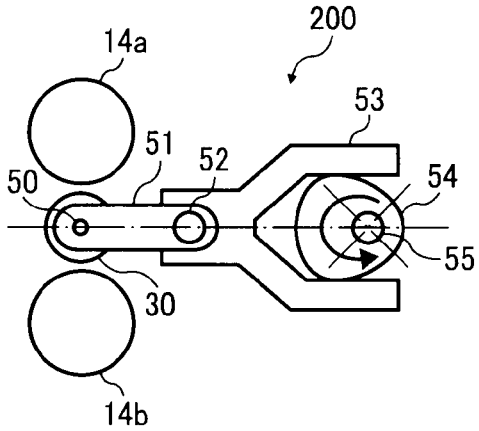
FIGS. 3A to 3D collectively schematically illustrates a configuration of a contacting and separating movement mechanism according to one embodiment of the present invention.
Figure 3B:
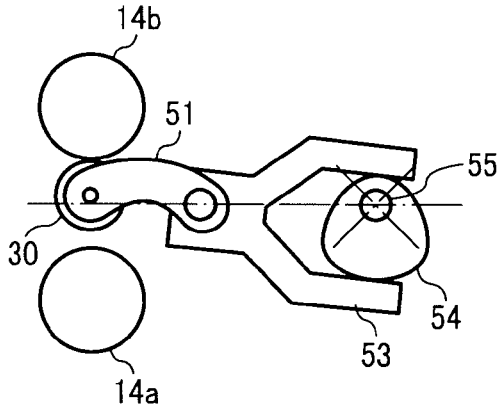
Figure 3C:
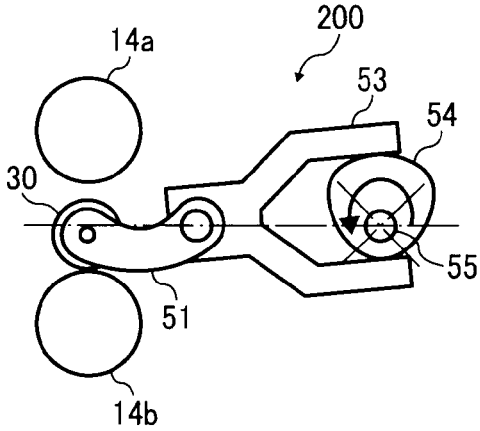
Figure 3D:
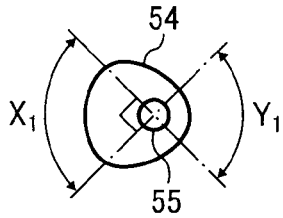

FIG. 3A illustrates an aspect when the first pressing roller 30 is positioned at a middle point and thus separates from both of the first and second registration rollers 14*a* and 14*b*. FIG. 3B illustrates an aspect when the first pressing roller 30 contacts the first registration roller 14*a*. FIG. 3C illustrates an aspect when the first pressing roller 30 contacts the second registration roller 14*b*. FIG. 3D illustrates a configuration of a pressure eccentric cam 54. As shown, the contact and separation mechanism 200 as a common roller moving device is connected to a contact and separation motor, not shown. A pressure eccentric cam 54 as shown 3D is secured to the rotary shaft 55 freely supported by the unit frame 19. As a contact and separation motor, a stepping motor capable of optionally adjusting a rotation amount and a stopping position is preferably employed. A pressing roller supporter 53 made of metal or resin almost wraps around the pressure eccentric cam 54 while contacting thereto. One end opposite to the other end of the pressure roller supporter 53, where the pressure eccentric cam 54 contacts, is freely supported by a supporting shaft 52 of the unit frame 19. Further, to this end, one end of a pressing roller supporting arm 51 is also secured. At the other end of the pressing roller supporting arm 51, the first pressing roller 30 is freely rotatably supported.

The pressing roller supporting arm 51 is composed of elastic material, such as a plate spring, rubber, etc. As shown 3B and 3C, when the first pressing roller 30 contacts the registration roller, the pressing roller supporting arm 51 elastically deforms in an arched state and biases the first pressing roller 30 toward the registration roller. Consequently, the first pressing roller 30 can contact the first and second registration rollers 14*a* and 14*b* with a prescribed pressure. Further, making the pressing roller supporting arm 51 of the elastic member, the first pressing roller 30 can contact the first and second registration rollers 14*a* and 14*b* with a simple configuration.

Further, the shape of the pressure eccentric cam 54 controlling movement of the first pressing roller 30 can be a perfect circle. However, a prescribed shape other than the perfect circle is preferably designed in view of a motion of the first pressing roller 30. Further, as shown 3D, the pressure eccentric cam 54 has a shape in which the longest range X1 distanced from a center of the rotary shaft 55 and the shortest range Y1 form a degree of angle about 90 in a rotation direction. Specifically, a difference in rotation angular phase between X1 and Y1 is 90 degrees. Accordingly, when the range between X1 and Y1 contact the pressure roller supporter 53, the first pressing roller 30 does not move (i.e., shift) and keeps the previous position regardless that the rotary shaft 55 is rotated. Hence, even though precision of keeping a rotational angle of the contact and separation motor, not shown, is inferior, a prescribed intended motion can be expected.

As shown 3A, in general, the first pressing roller 30 is located at an intermediate position separated from the registration rollers 14*a* and 14*b*. At that moment, the range between X1 and Y1 of the pressure eccentric cam 54 of FIG. 3D does not contact the pressure roller supporter 53. As shown 3B, to bring the first pressing roller 30 in contact with the first registration roller 14*a*, the pressure eccentric cam 54 is rotated by 90 degrees of angle counter clockwise. Consequently, a lower (contact) section (i.e., on the side of the second registration roller) of the pressure roller supporter 53 in the drawing contacts the range X1, while an upper (contact) section (i.e., on the side of the first registration roller) of the pressure roller supporter 53 in the drawing contacts the range Y1. Hence, the first pressing roller 30 moves to the side of the first registration roller and contacts them, while the pressing roller supporting arm 51 elastically deforms and biases the first pressing roller 30 toward the first registration roller.

When the pressure eccentric cam 54 is further rotated by 90 degrees of angle from the state of FIG. 3B, the first pressing roller 30 separates from the first registration roller 14*a* and stops at the middle point as shown 3A. When the pressure eccentric cam 54 is further rotated counter clockwise by 90 degrees of angle, the first pressing roller 30 moves downward in the drawing from the middle point (i.e., on the side of the second registration roller 14*b*) and contacts the second registration roller 14*b* as shown 3C. Further, the pressing roller supporting arm 51 elastically deforms and biases the first pressing roller 30 toward the second registration roller. At that moment, a lower contact section (i.e., on the side of the second registration roller) of the pressure roller supporter 53 of the pressure eccentric cam 54 in the drawing contacts the range Y1, while an upper contact section (i.e., on the side of the first registration roller) of the pressure roller supporter 53 in the drawing contacts the range X1 of the pressure eccentric cam 54.

Figure 4A:
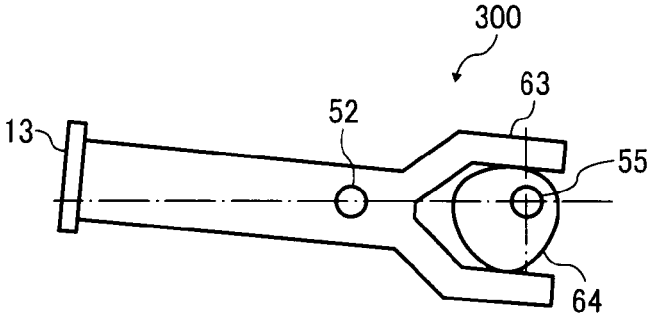
FIGS. 4A and 4B collectively schematically illustrates a configuration of a gate movement mechanism according to one embodiment of the present invention.

Now, a gate moving mechanism to move the gate 13 is described with reference to FIGS. 4A and 4B. As shown, the former drawing schematically illustrates a configuration of a gate moving mechanism 300. The latter drawing schematically illustrates a gate eccentric cam 64. As shown, the gate moving mechanism 300 is as a bumper moving device and employs an eccentric cam mechanism as the contact and separation mechanism 200 of the first pressing roller 30. In this embodiment, the motor that drives the contact and separation mechanism 200 also drives the gate moving mechanism 300 to decrease the number of motors and thereby widely saving a space.

The gate 13 is secured to one end of a gate supporter 63 not to be vibrated during movement. The gate supporter 63 is freely rotatably supported by the supporting shaft 52 together with the pressure roller supporter 53. The other end of the gate supporter 63 contacts a gate eccentric cam 64 secured to the rotary shaft 55 together with the pressure eccentric cam 54. The gate eccentric cam 54 has substantially the same shape as the pressure eccentric cam 54, and is secured to the rotary shaft 55 having a difference in rotation angular phase of 45 degrees from to the pressure eccentric cam 54 as shown 4B.

Figure 4B:
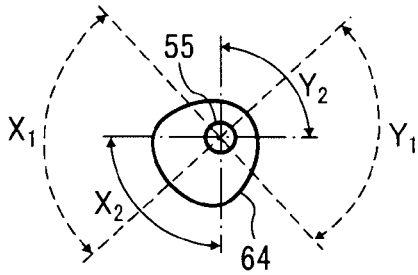
Figure 5:
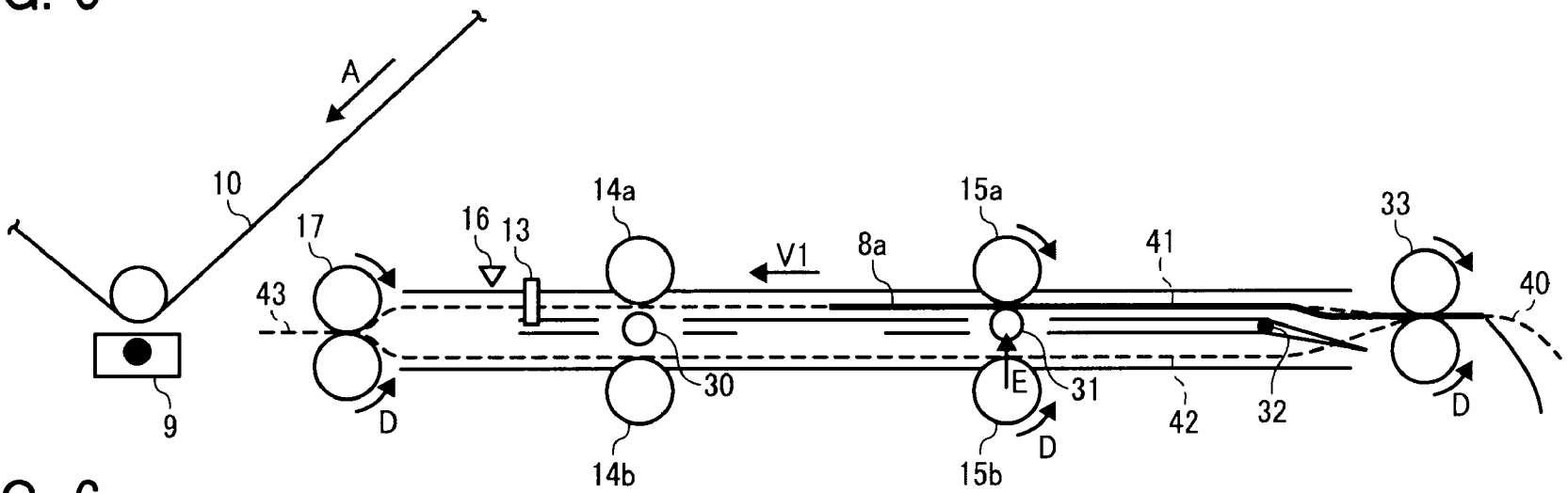
FIG. 5 illustrates an aspect of the sheet conveyance device when a first sheet is conveyed to a first sheet conveyance path according to one embodiment of the present invention.
Figure 8:
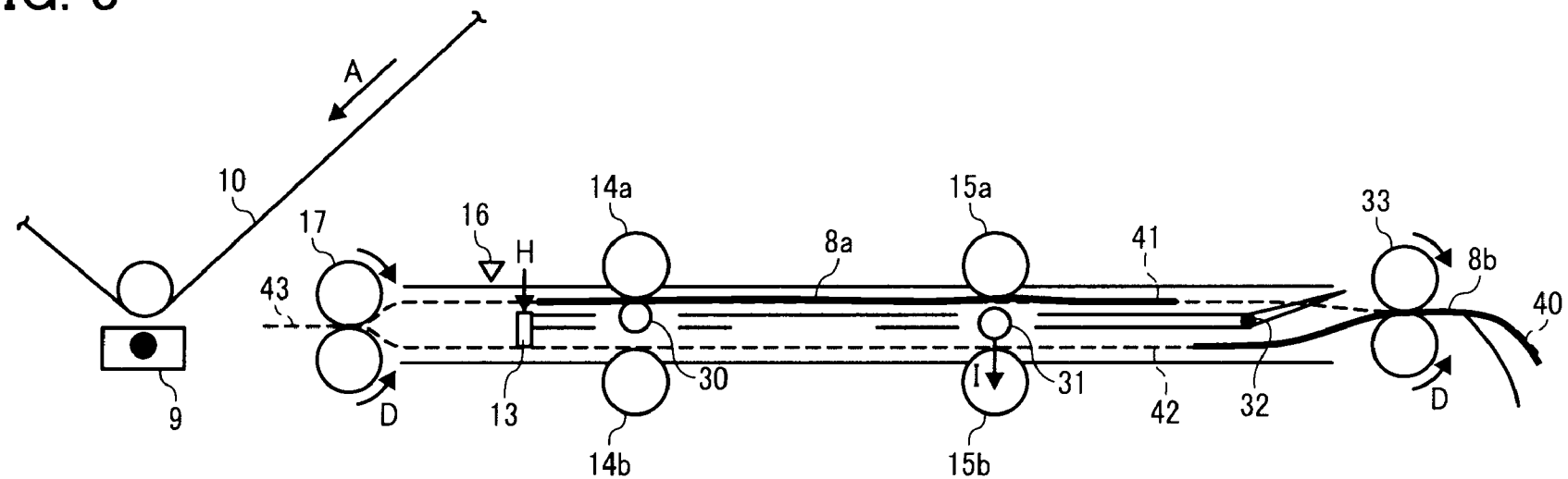
FIG. 8 illustrates an aspect of the sheet conveyance device when the gate and a second pressing roller are moved to intermediate positions, respectively, according to one embodiment of the present invention.
Figure 9A:
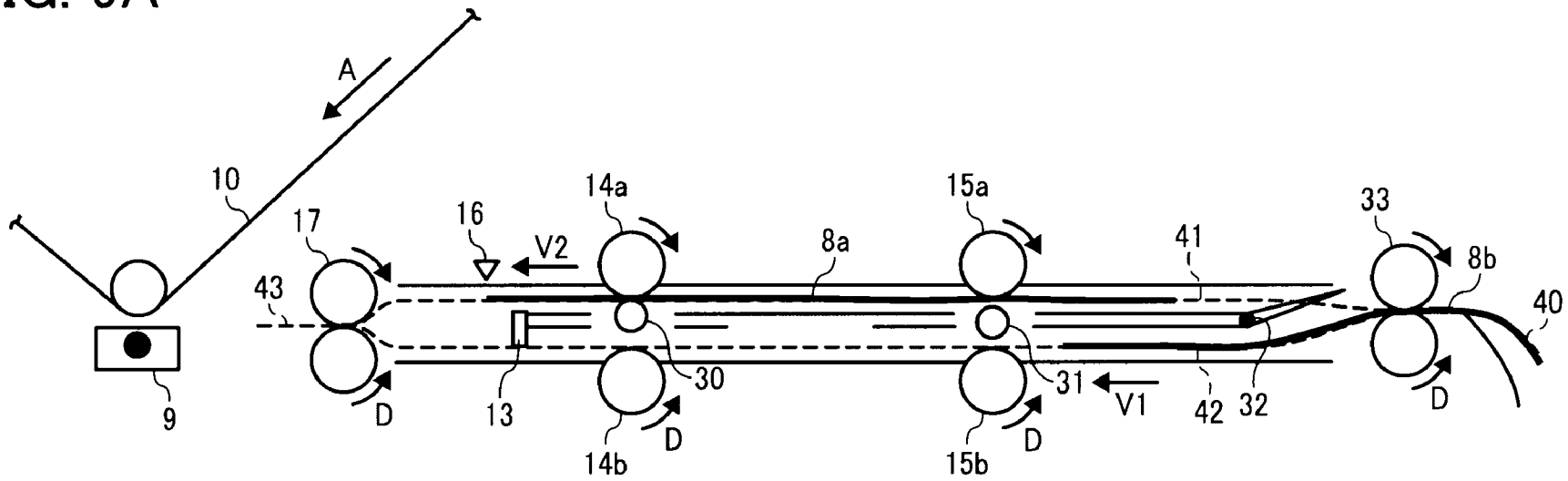
FIGS. 9A and 9B collectively illustrate an aspect of the sheet conveyance device when a first sheet is conveyed into a secondary transfer unit according to one embodiment of the present invention.
Figure 9B:
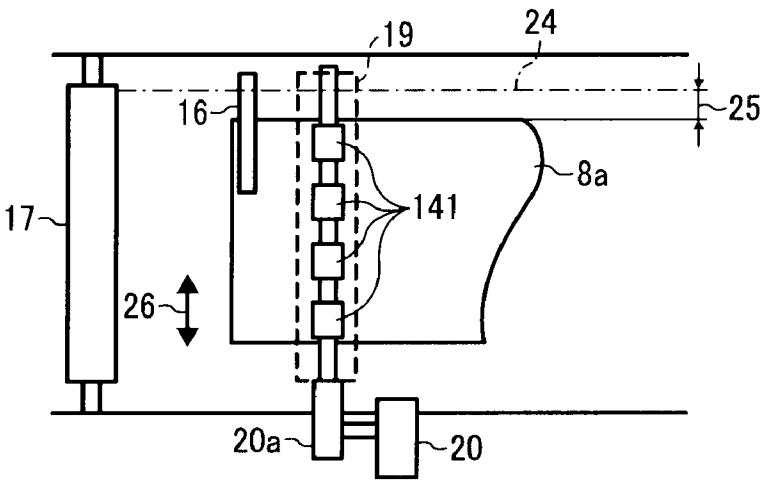

When the gate eccentric cam 64 is located at a position of FIG. 4B, the first pressing roller 30 is located at the middle point as shown 3B, while the gate 13 is located on the side of the first sheet conveyance path as shown 4A (see FIG. 5). From this condition, when the rotary shaft 55 is rotated counter clockwise by 45 degrees of angle, the first pressing roller 30 contacts the first registration roller 14*a*, while the gate 13 does not change the previous position in the side of the first sheet conveyance path 41 as shown 7. When the rotary shaft 55 is further rotated counter clockwise by 90 degrees of angle, the gate 13 is located at the middle point between the first and second sheet conveyance paths 41 and 42, while the first pressing roller 30 does not move remaining in contact with the first registration roller 14*a* as is as shown in FIGS. 8 to 10. From this condition, when the rotary shaft 55 is further rotated counter clockwise by 45 degrees of angle in the drawing, the gate 13 moves to the second sheet conveyance path 42, while the first pressing roller 30 moves from a position in contact with the first registration roller 14*a* to the middle point as shown in FIG. 11. Further, when the shaft 55 stops its rotation at this middle point, the first pressing roller 30 neither contacts the first nor second registration roller, while the gate is open in the first and second sheet conveyance paths. When the rotary shaft 55 is further rotated counter clockwise by 45 degrees of angle in the drawing, the gate 13 does not move staying on the side of the second sheet conveyance path 42, while the first pressing roller 30 moves from the middle point to a position in contact with the second registration roller 14*b*. From this condition, when the rotary shaft 55 is further rotated counter clockwise by 45 degrees of angle in the drawing, the gate 13 moves to the middle point, while the first pressing roller 30 does not move and stay in contact with the second registration roller 14*b* as is. Subsequently, when the rotary shaft 55 is further rotated counter clockwise by 45 degrees of angle in the drawing, the gate 13 moves to the side of the first sheet conveyance path, while the first pressing roller 30 moves from a position in contact with the second registration roller 14*b* to the middle point to be an initial state. Further, when the shaft 55 stops its rotation at this middle point, the first pressing roller 30 neither contacts the first nor second registration roller, while the gate is open in both of the first and second sheet conveyance paths.

Hence, when the pressure eccentric cam 54 and the gate eccentric cam 64 having the longest and shortest distance ranges X and Y ranging 90 degrees of angle having a phase difference of 90 degrees are attached to the rotary shaft 55 with 45 degrees of a phase difference from each other, respectively, and a rotation angle of the rotary shaft is controlled, the below listed seven positional relations between the gate 13 and the first pressing roller 30 are established. A first relation is that the gate 13 is located on the side of the first conveyance path, while the first pressing roller 30, the middle point, respectively. A second relation is that the gate 13 is located on the side of the first conveyance path, while the first pressing roller 30 contacts the first registration roller 14*a*. A third relation is that the gate 13 is located at the middle point, while the first pressing roller 30 contacts the first registration roller 14*a*. A fourth relation is that the gate 13 is located on the side of the second conveyance path, while the first pressing roller 30, the middle point, respectively. A fifth relation is that the gate 13 is located on the side of the second conveyance path, while the first pressing roller 30 contacts the second registration roller 14*b*. A sixth relation is that the gate 13 is located at the middle point, while the first pressing roller 30 contacts the second registration roller 14*b*. A seventh relation is that the gate 13 does not shut any conveyance path, while the first pressing roller 30 doe not contact any registration roller.

The pressing rollers 30 and 31 as well as the gate 13 each can employ a solenoid rather than the eccentric cam.

Now, a sheet conveyance operation is described with reference to FIGS. 5 to 11. Initially, when it starts feeding a first sheet 8*a*, a controller, not shown, directs a leading end of the bifurcation pick 32 to the side of the second sheet conveyance path. At the same time, the controller locates the gate 13 on the side of the first sheet conveyance path, and the first and second pressing rollers 30 and 31 at middle points, respectively. In such a condition, a single sheet 8*a* is launched from a sheet feeding unit, not shown, guided by the bifurcation pick 32, and further conveyed to the first sheet conveyance path 41 by the pair of conveyance rollers 33 as shown in FIG. 5.

When the leading end of the first sheet 8*a* passes through the first conveyance roller 15*a*, the second pressing roller 31 is moved to a direction as shown by an arrow E of FIG. 5 and contacts the second pressing roller 31 via the sheet 8*a*. The reason for such a sequence is that if the second pressing roller 31 contacts the first conveyance roller 15*a* before the leading end of the first sheet 8*a* passes through contact section (i.e., a nip) between the first conveyance roller 15*a* and the second pressing roller 31, since a diameter of the second pressing roller 31 is sufficiently small in comparison with that of the conveyance rollers 15*a* and 15*b* as described above, the leading end cannot smoothly enter the nip and possibly generates sheet jamming therein. Further, the second pressing roller 31 can contact at an optional time during when the leading end of the first sheet 8*a* passes through the conveyance roller 15*a* and a trailing end thereof exits the pair of conveyance rollers 33. For example, the controller, not shown, may start counting after start feeding a sheet and moves the second pressing roller 31 to the side of the first conveyance roller 15*a* when counting up a prescribed amount. The prescribed amount corresponds to a time when sheet feeding starts to when the leading end of the first sheet 8*a* definitely exits the conveyance roller 15*a*.

Figure 6:
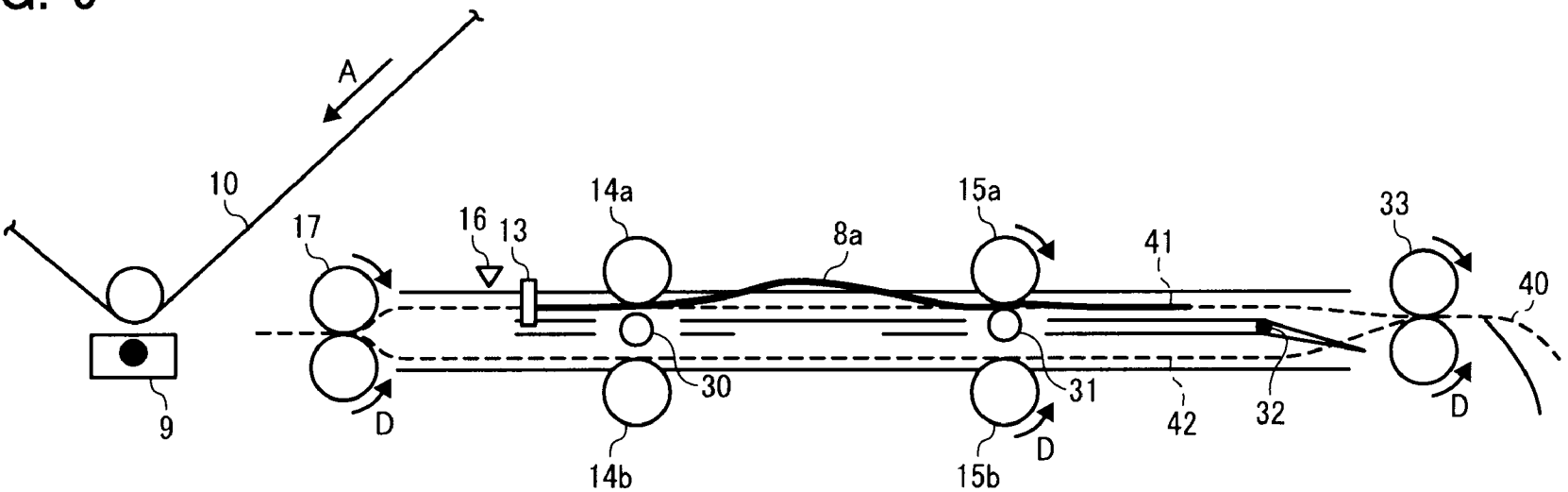
FIG. 6 illustrates an aspect of the sheet conveyance device when the first sheet abuts a gate according to one embodiment of the present invention.

The first sheet 8*a* sandwiched by the second pressing roller 31 and the first conveyance roller 15*a* is conveyed toward the gate 13 by a driving force applied by the first conveyance roller 15*a* at a prescribed sheet feeding speed V1 and abuts the gate 13 at its leading end. Subsequently, from when the leading end abuts the gate 13, the trailing end of the first sheet 8*a* is further conveyed as an excessive conveyance by a pair of first conveyance rollers composed of the first conveyance roller 15*a* and the second pressing roller 31. Consequently, the first sheet 8*a* bends as shown in FIG. 6. Hence, by excessively feeding the sheet 8*a* even when the leading end of the sheet dumps into the gate 13 and bends the sheet, skew of the sheet (i.e., oblique deviation) can be corrected (i.e., substantially disappears from the sheet 8*a*).

Figure 7:
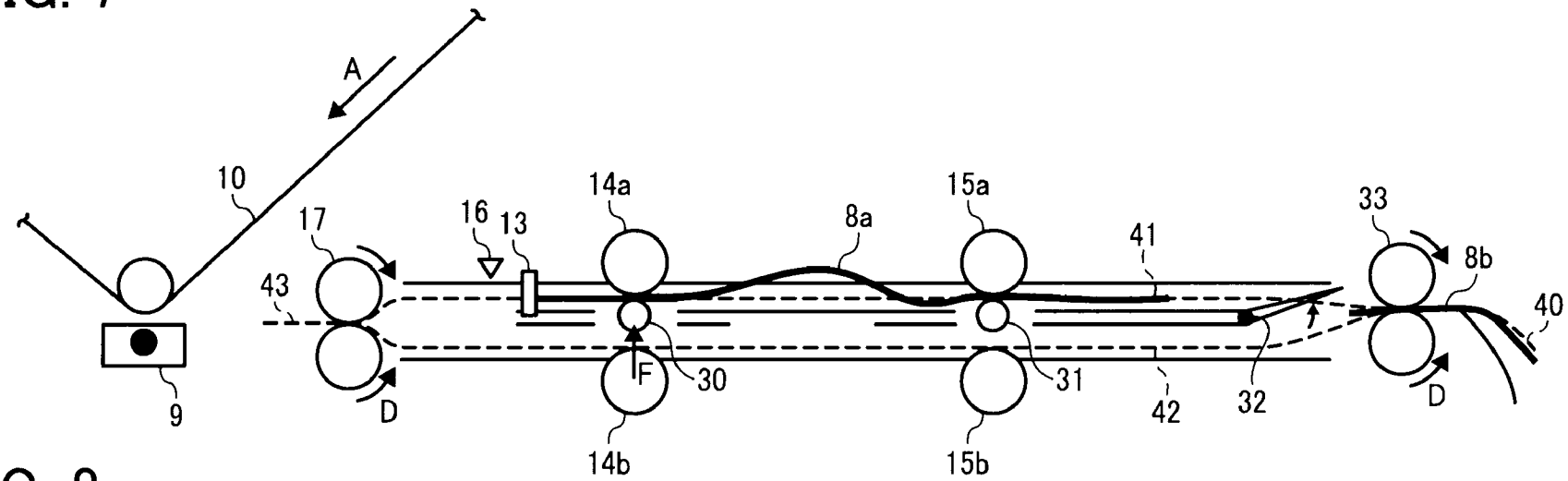
FIG. 7 illustrates an aspect of the sheet conveyance device when a first pressing roller is pressed against a first registration roller according to one embodiment of the present invention.

Subsequently, as shown in FIG. 7, the controller moves the first pressing roller 30 to the first registration roller 14*a* (in a direction as shown by an arrow F) so that the first pressing roller 30 and the first registration roller 14*a* sandwich the sheet 8*a* therebetween. At that moment, a second sheet 8*b* is subsequently conveyed to and reaches the pair of conveyance rollers 33. Then, the bifurcation pick 32 is rotated counter clockwise in the drawing (i.e., in a direction as shown by an arrow G) to direct its leading end on the side of the first conveyance path 41.

Subsequently, as shown 8, the controller moves the gate 13 in a direction as shown by an arrow H in the drawing to position at a middle point between the first and second sheet conveyance paths 41 and 42. However, the gate 13 can be moved up to the second sheet conveyance path 42. To readily realize such a movement of the gate 13, shapes of the above-described pressure eccentric cam 54 and the gate eccentric cam 64 as well as a difference in rotational phase angle between the pressure eccentric cam 54 and gate eccentric cam 64 are appropriately designed.

Further, at the same time, the controller moves the second pressing roller 31 in a direction as shown by an arrow I in the drawing to the middle points not to contact any conveyance roller from the position in contact with the first conveyance roller 15*a*. Hence, pressing against the sheet in the vicinity of the trailing end thereof in the first sheet conveyance path 41 is released, the bending of the first sheet 8*a* disappear in the first sheet conveyance path 41 to return to a linear state. Consequently, a positional deviation caused on the upstream side of the first registration roller 14*a* can also corrected and disappear. Further, the second sheet 8*b* is directed and launched into the second sheet conveyance path 42 by the bifurcation pick 32 and the pair of conveyance rollers 33.

Further, as shown 9A, the controller starts rotating and driving the first registration roller 14*a* synchronizing with a toner image carried on the transfer belt 10. Specifically, the controller starts driving of the first registration roller 14*a* when a leading end of the toner image on the transfer belt 10 in a rotational direction synchronizes with that of the first sheet 8*a* in a conveyance direction. The controller further conveys the first sheet 8*a* in a direction as shown by an arrow at a prescribed process speed V2. The process speed V2 is slower than the above-described sheet feeding speed V1 to upgrade image quality and make parts life longer. Accordingly, when productivity obtained after correction of skew is equalized to that obtained before the correction of skew, a sheet interval between sheets conveyed in the process speed V2 becomes shorter than that between sheets conveyed in the sheet feeding speed V1. Accordingly, the second sheet 8*b* conveyed to the second sheet conveyance path 42 at the sheet feeding speed V1 catches up a trailing end of the first sheet 8*a* conveyed at process speed V2. However, according to this embodiment, since a pair of sheet conveyance paths 41 and 42 are employed, a problem, such as double feeding, etc., substantially does not occur even when the second sheet 8*b* catches up the trailing end of the first sheet 8*a*.

Further, the controller detects an amount of lateral deviation (25) of a sheet in a main scanning direction from a reference conveyance line 24 based on a detection result of a sheet detection sensor 16 that detects a lateral position of a sheet in the main scanning direction. The controller then drives a main scanning direction movement motor 20 and rotates a cam 20*a* engaging the unit frame 19, and moves the unit frame 19 in the main scanning direction by a prescribed amount in accordance with the sheet deviation amount 25. Hence, a first registration roller 14*a* and a first pressing roller 30 supported on the unit frame 19 move in the main scanning direction, and accordingly the first sheet 8*a* sandwiched by the first registration roller 14*a* and the first pressing roller 30 moves in the same direction together therewith. Hence, the lateral deviation of the first sheet 8*a* in the main scanning direction (i.e., a direction as shown by an arrow in the drawing) is corrected and substantially disappears as shown in FIG. 10B.

Figure 10A:
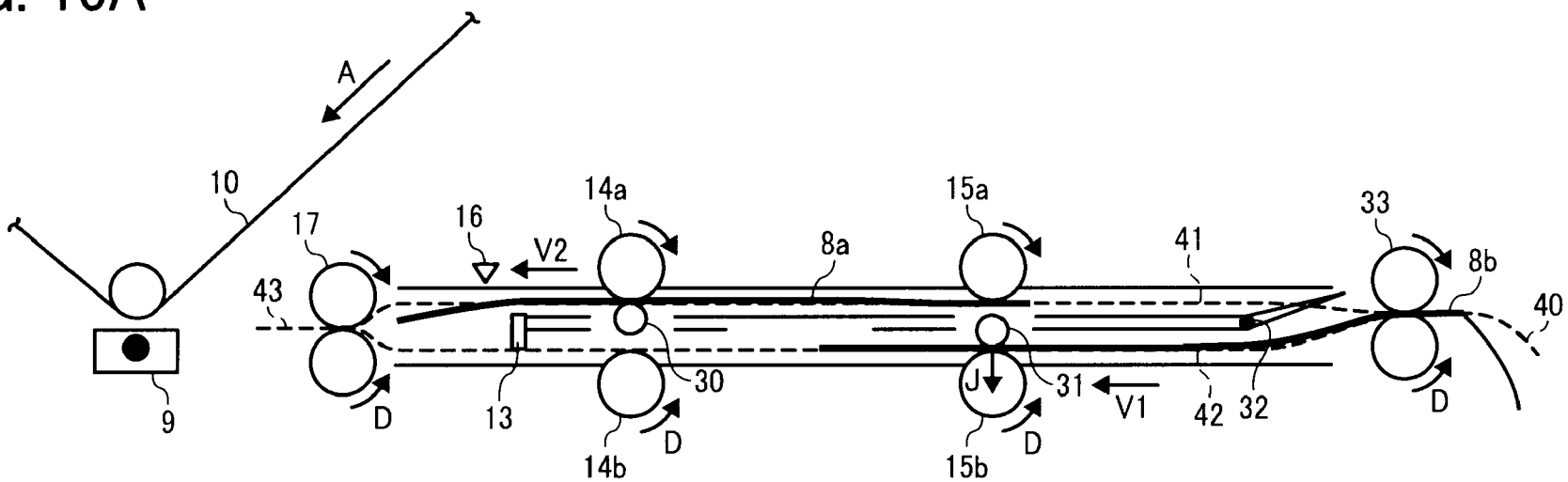
FIGS. 10A and 10B collectively illustrate an aspect of the sheet conveyance device when a second pressing roller is pressed against a second conveyance roller according to one embodiment of the present invention.
Figure 10B:
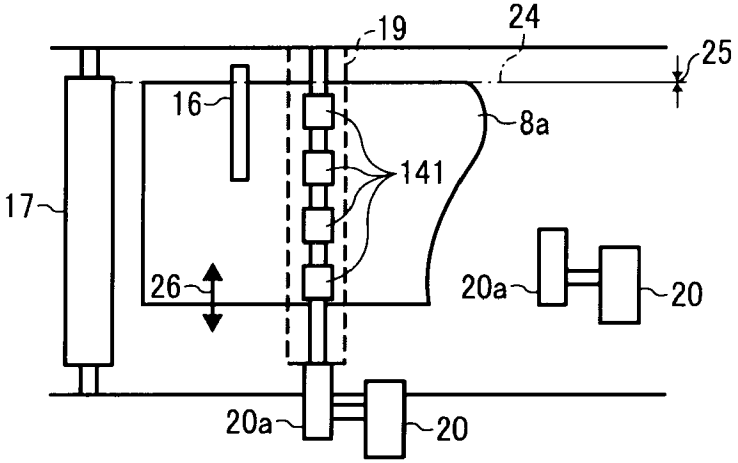
Figure 11:
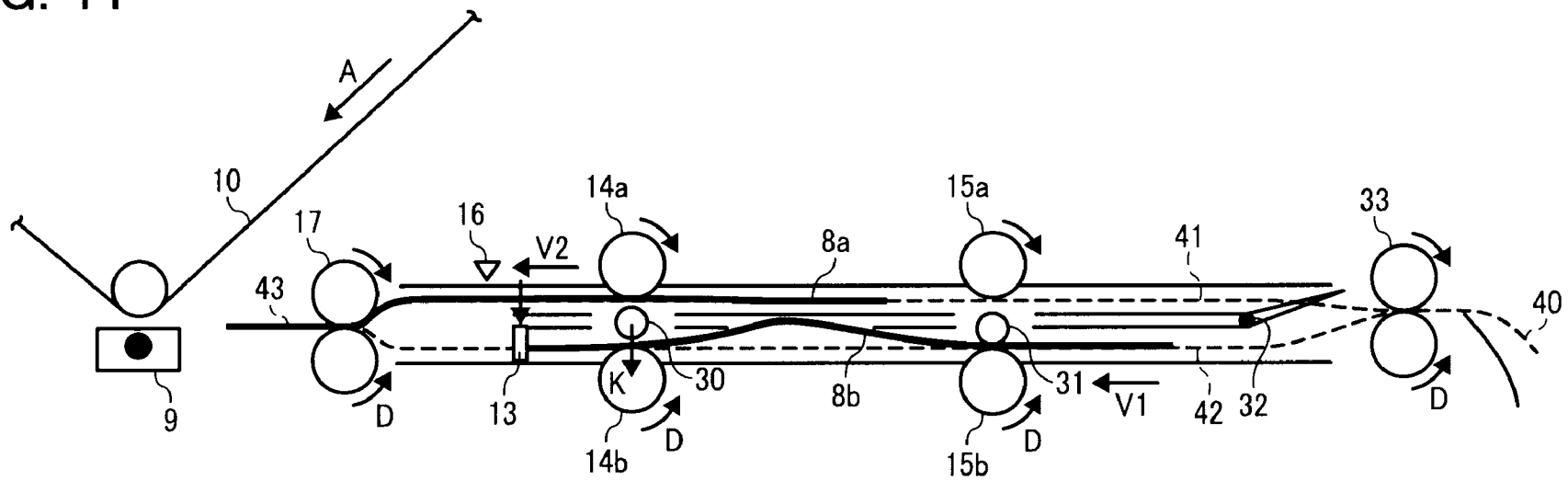
FIG. 11 illustrates an aspect of the sheet conveyance device when the gate is moved to a second sheet conveyance path and the first pressing roller is moved to the intermediate position according to one embodiment of the present invention.

Further, as shown in FIG. 10A, when a second sheet 8*b* passes through the second conveyance roller 15*b*, the controller moves the second pressing roller 31 to the side of the second conveyance roller 15*b* (i.e., a direction as shown by an arrow J), so that the second pressing roller 31 and the second conveyance roller 15*b* sandwiches and conveys the second sheet 8*b* to the gate 13 at a prescribed sheet feeding speed V1.

Subsequently, as shown in FIG. 11, when the leading end of the first sheet 8*a* reaches a nip formed between a pair of timing rollers 17 and thereby entering a condition in which the pair of timing roller is ready to convey the first sheet 8*a* forward, the first pressing roller 30 pressing the first sheet 8*a* against the first registration roller 14*a* separates therefrom and moves to a middle point distanced from both of the first and second registration rollers 14*a* and 14*b*. Further, the gate 13 moves from the middle point to the second sheet conveyance path 42. When the first pressing roller 30 moves to the middle point, the controller controls the main scanning direction movement motor 20 to return the unit frame 19 (first and second registration rollers 14*a* and 14*b*, as well as a first pressing roller 30) to an initial position to deal with lateral deviation of the second sheet 8*b* in the main scanning direction.

Figure 12:
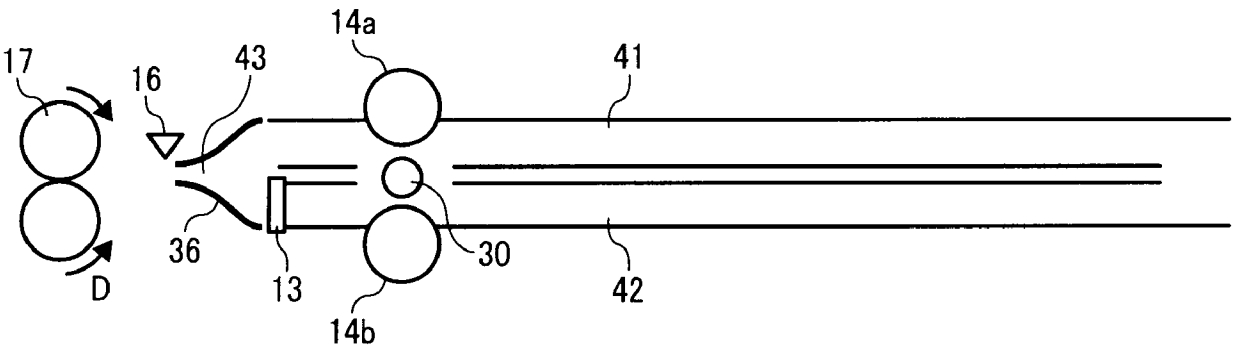
FIG. 12 schematically illustrates a modified configuration of the pair of registration rollers and a pair of timing rollers according to another embodiment of the present invention.

Further, due to a difference in sheet bumping position at the gate 13 in the sub scanning direction in between the sheet conveyance paths 41 and 42, sheet conveyance distances from the sheet bumping positions in these paths to the secondary transfer unit become different from each other. Consequently, due to the variation of the sheet conveyance distance, the leading end of the toner image on the transfer belt 10 in the rotation direction does not always coincide with a prescribed position of the leading end of the sheet 8 in the conveyance direction. Such inconcinnity is also caused when a sheet conveyance start time in these paths is different from each other due to a difference in backlash of gears that transmit driving forces to the registration rollers 14*a* and 14*b* or the like. Further, as shown in FIG. 12, when a shape of the conveyance path extended from the gate 13 to the detection sensor 16 is different in the first ad second sheet conveyance paths, arriving times at the secondary transfer unit is sometimes different in the first and second conveyance paths due to curl of the leading end of the sheet. Then, according to this embodiment of the present invention, a difference in conveyance time of a sheet 8 is detected and checked, and a rotational speed of the driving motor driving the pair of timing rollers 17 is corrected and adjusted so that the sheets conveyed from the first and second sheet conveyance paths can reach the secondary transfer unit substantially at the same. Specifically, the controller starts timekeeping based on start of image formation (e.g. start of exposure) until when a leading end detector, not shown, disposed in the vicinity of a nip of the pair of timing rollers detects the leading end thereof as a confluence sheet conveyance device. When the nip reaching time is substantially equivalent to a prescribed reference time, conveyance is executed as is. Because, the leading end of the sheet in the sheet conveyance direction conveyed to the secondary transfer unit coincides with the leading end of the toner image on the transfer belt 10 in the belt rotation direction. Whereas when the nip reaching time is deviated from the prescribed reference time, and accordingly the leading end of the toner image on the transfer belt 10 does not coincide with that of the sheet, the controller as a time correction device corrects and adjusts a rotational speed of the driving motor that drives the pair of timing rollers 17 to achieve the above-described coincidence.

Further, as shown in FIG. 11, a pair of second conveyance rollers composed of a second conveyance roller 15*b* and a second pressing roller 31 stop and bend a second sheet 8*b* when a leading end of the second sheet 8*b* is driven in and abuts the gate 13 before the trailing end of the first sheet 8*a* exits the first sheet conveyance path 41. Hence, skew of the second sheet 8*b* is corrected and substantially disappear therefrom before the trailing end of the first sheet 8*a* exits the first sheet conveyance path. Subsequently, the first pressing roller 30 moves to the side of the second registration roller 14*b* and presses the second sheet 8*b* against the second registration roller 14*b*. Then, the second pressing roller 31 is moved to the middle point to release the bending of the second sheet 8*b*. Subsequently, the gate 13 is moved to the middle point between the first and second sheet conveyance paths 41 and 42, and enters into a standby state until the trailing end of the first sheet 8*a* is converted to a prescribed position after sneaking out from the first sheet conveyance path 41.

Subsequently, a third sheet (8*c* not shown) is conveyed to the first sheet conveyance path 41 while a fourth sheet (8*d* not shown) is after that conveyed to the second conveyance path 42. In this way, sheets are alternately conveyed through the paths and the above-described operations are repeated.

Further, a time from when skew correction of the previous sheet is completed to when the trailing end thereof exits the gate 13 in the skew correction mechanism (i.e., the gate 13, the pair of registration rollers, and the pair of pushing rollers) is longer than that needed for the skew correction in this embodiment. However, since the pair of conveyance paths 41 and 42 are arranged with the skew correction mechanisms, respectively, a subsequent sheet can be conveyed and enter a standby state by receiving skew correction in one of the sheet conveyance paths during when the previous sheet completes its skew correction and exits the gate 13 with its trail end in the other one of the sheet conveyance paths. Consequently, a subsequent sheet can be immediately started conveying right after the trailing end of the former sheet exits one of the sheet conveyance paths. Accordingly, sheets can be conveyed to the secondary transfer unit at extremely short sheet interval.

Further, since the pressing roller constituting the pair of registration rollers in the first sheet conveyance path 41 and that constituting the pair of the registration rollers in the second sheet conveyance path 42 arranged parallel thereto are common, and the pressing roller constituting the pair of pressing rollers in the first sheet conveyance path 41 and the pressing roller constituting the pair of the pushing rollers in the second sheet conveyance path 42 are common, a gap between the first and second sheet conveyance paths 41 and 42 can be minimized, thereby making the sheet conveyance device compact.

Further, in comparison with a system as described in Japanese Patent Application Publication No. 2008-24507, since the pressing roller and the contact and separation mechanism are commonly used, the number of parts can be decreased saving natural resources.

Further, even though the gate is used to correct sheet skew with high precision as described above, it can be omitted. In such a situation, the first pressing roller 30 is pressed against the first registration roller 14*a* and forms a nip thereon. Then, the sheet is conveyed to bump into the nip to correct skew there. Consequently, similar to the system as described above, the second pressing roller 31 is separated from the first conveyance roller 15*a*, and the first registration roller 14*a* is driven at a prescribed time to convey the sheet. When the leading end of the sheet reaches the nip of them and the pair of timing rollers 17 conveys the sheet forward, the first pressing roller 30 is separated from the first registration roller 14*a* and contacts the second registration roller 14*b*. Specifically, with such a configuration, the pair of registration rollers 14 constitutes a sheet bumper unit.

Further, in the above-described embodiment, a line type CCD is employed as the sheet detection sensor 16. However, since the line type CCD is bulky, an image formation apparatus cannot practically secure a space therefor therein. In such a situation, a small line type CIS can be used as the sheet detection sensor. However, since the small line type CIS only has a shallow detection depth, lateral deviation of the sheet in the main scanning direction in the first and second sheet conveyance paths 41 and 42 cannot be detected by a single sheet detection sensor 16 composed of the small line type CIS. Accordingly, a pair of sheet detection sensors 16 need to be disposed on both of the first and second sheet conveyance paths 41 and 42, and thereby increasing a cost of the apparatus. Thus, when it is used as the sheet detection sensor 16, the line type CIS is preferably arranged on a confluence sheet conveyance path 43 in which the first and second sheet conveyance paths flow into each other. In such a situation, with the configuration as described above with reference to FIG. 2, the confluence sheet conveyance path 43 is disposed downstream of the pair of timing rollers 17. Accordingly, a distance from the sheet detection sensor 16 to the secondary transfer unit is short, and accordingly a sheet enters the secondary transfer unit before the sheet detection sensor 16 detects lateral deviation of the sheet in the main scanning direction and corrects thereof. For this reason, the sheet detection sensor 16 may more preferably be disposed upstream far from the secondary transfer unit as shown in FIG. 12. Specifically, a pair of guides 36 are disposed between the gate 13 and the pair of timing rollers 17 to guide a sheet so that the first and second sheet conveyance paths 41 and 42 flow thereinto. Hence, the confluence sheet conveyance path 43 can be formed before the pair of timing rollers 17. As a result, although the line type CIS is used and disposed as the sheet detection sensor 16 before the pair of timing rollers 17, lateral deviation of the sheet in the main scanning direction can be precisely detected. Further, the sheet detection sensor 16 can be distanced far from the secondary transfer unit, and accordingly the lateral deviation of the sheet in the main scanning direction can be appropriately corrected before the sheet reaches the secondary transfer unit.

Although a single conveyance path is extended from the sheet feeding unit to the pair of conveyance rollers 33 while dual conveyance paths 41 and 42 start thereafter in this embodiment, the first and second sheet conveyance paths 41 and 42 can be extended up to sheet feeding units respectively conveying sheets therethrough. In such a situation, one of the pair of conveyance rollers disposed upstream of the pair of conveyance rollers can be commonly used in the both sheet conveyance paths 41 and 42.

Hence, although one of the pressing roller of the pair of registration rollers and that of the pair of conveyance rollers are commonly used in each of the sheet conveyance paths 41 and 42 in this embodiment, one of the pressing roller of the pair of registration rollers or that of the pair of conveyance rollers can be commonly used there.

Further, the above-described sheet conveyance device of various embodiments can also be applied to a post processing apparatus and an automatic document feeder (ADF) in addition to the above-described image formation apparatus.

Numerous additional modifications and variations of the present invention are possible in light of the above teachings. It is therefore to be understood that within the scope of the appended claims, the present invention may be practiced otherwise than as specifically described herein.

What is claimed is:

1. A sheet conveyance device comprising:

a first sheet conveyance roller unit disposed in a first sheet conveyance path to receive and convey a sheet;

a first skew corrector disposed in the first sheet conveyance path to correct skew of the sheet;

a second sheet conveyance roller unit disposed in a second sheet conveyance path to receive and convey a sheet, said a second sheet conveyance path being disposed parallel to the first sheet conveyance path;

a second skew corrector to correct skew of the sheet disposed in the second sheet conveyance path; and a third conveyance path disposed downstream of the first sheet conveyance path and the second sheet conveyance path, into which the first sheet conveyance path and the second sheet conveyance path merge, the sheet being alternately conveyed to the first sheet conveyance path and the second sheet conveyance path, wherein the first sheet conveyance roller unit and the second sheet conveyance roller unit share a common roller.

2. The sheet conveyance device as claimed in claim 1, wherein each of the first sheet conveyance roller unit and the second sheet conveyance roller unit comprises a driving roller and a driven roller, and the driven roller is the common roller.

3. The sheet conveyance device as claimed in claim 1, wherein each of the first skew corrector and the second skew corrector comprises:

a bumper against which a leading end of a conveyed sheet is contacted, wherein each of the first sheet conveyance roller unit and the second sheet conveyance roller unit includes:

a pair of registration rollers disposed upstream of the bumper in the sheet conveyance direction to convey a skew corrected sheet to the third conveyance path; and a pair of pushing rollers to push the sheet after the sheet bumps into the bumper, wherein at least one of the pair of registration rollers or at least one of the pair of the pushing rollers in the first and second conveyance paths is the common roller.

4. The sheet conveyance device as claimed in claim 3, wherein the common roller of each of the pair of registration rollers and the pair of the pushing rollers is configured to move between a first intermediate position not contacting another roller than the common roller in each of the pair of registration rollers and the pair of the pushing rollers and a second position contacting the other roller to sandwich the sheet with its leading end passing through the other roller than the common roller in the respective sheet conveyance paths.

5. The sheet conveyance device as claimed in claim 4, further comprising:

a pair of upstream conveyance rollers disposed upstream of the pair of pushing rollers in the sheet conveyance direction; and a pair of downstream conveyance rollers disposed downstream of the pair of registration rollers in the sheet conveyance direction, wherein one of the pair of registration rollers and that of pushing rollers are the common rollers in the respective sheet conveyance paths, wherein the common roller contacts the other roller of the pair of pushing rollers sandwiching the sheet therebetween before a trailing end of the sheet exits from the pair of upstream conveyance rollers, wherein the common roller contacts the other roller of pair of registration rollers sandwiching the sheet therebetween after the leading end of the sheet conveyed by the pair of pushing rollers is contacted and stops at the bumper, wherein the common roller separates from the other roller of the pair of pushing rollers and moves to the intermediate position as the common roller contacts the other roller of pair of registration rollers sandwiching the sheet therebetween, and wherein the common roller separates from the other roller of the pair of registration rollers and moves to the intermediate position as the sheet is conveyed by the pair of downstream conveyance rollers.

6. The sheet conveyance device as claimed in claim 3, wherein the first skew corrector serves as the second skew corrector.

7. The sheet conveyance device as claimed in claim 3, further comprising an eccentric cam to move the bumper between the first sheet conveyance path and the second sheet conveyance path.

8. The sheet conveyance device as claimed in claim 7, wherein the eccentric cam that moves the bumper and the eccentric cam that moves common roller are secured to the same shaft at different phase angles from each other in a rotational direction.

9. The sheet conveyance device as claimed in claim 8, wherein the eccentric cam that moves the bumper and that of the eccentric cam that moves the common roller have the same curvature in a prescribed angular range.

10. The sheet conveyance device as claimed in claim 1, wherein each of the first skew corrector and the second skew corrector comprises:

a bumper against which a leading end of a conveyed sheet is contacted, wherein each of the first sheet conveyance roller unit and the second sheet conveyance roller unit includes:

a pair of registration rollers disposed upstream of the bumper in the sheet conveyance direction to convey a skew corrected sheet to the third conveyance path; and a pair of pushing rollers to push the sheet after the sheet bumps into the bumper, wherein at least one of the pair of registration rollers and at least one of the pair of the pushing rollers in the first and second conveyance paths are the common rollers, respectively.

11. The sheet conveyance device as claimed in claim 1, wherein each of two pairs of registration rollers in the first sheet conveyance path and the second sheet conveyance path is contacted by a leading end of the sheet at a nip formed between the pair of the registration rollers as the first skew corrector or the second skew corrector, wherein one of two pairs of the pushing rollers pushes the sheet to the nip formed between the pair of the registration rollers and one of two pairs of the registration rollers conveys a skew corrected sheet to the third conveyance path, wherein at least one of the pair of registration rollers and at least one of the pair of pushing rollers serve as the common rollers in the first sheet conveyance path and the second sheet conveyance path.

12. The sheet conveyance device as claimed in claim 11, wherein one of the pair of pushing rollers is configured to move between a first intermediate position not contacting the other roller of the pair of pushing rollers in each of the first and second conveyance paths, and contacts the other rollers sandwiching the sheet therewith as the leading end of the sheet passes through the other roller, wherein the common roller of the pair of pushing rollers is moved to the intermediate position from the position in contact with the other roller of the pair of pushing rollers when the pair of registration rollers starts conveying the sheet.

13. The sheet conveyance device as claimed in claim 11, further comprising a downstream sheet conveyance path disposed right downstream of the pair of registration rollers;

wherein one of the pair of registration rollers is the common roller and configured to move to contact and separate from another roller than the common roller of the pair of registration rollers in each of the first and second conveyance paths, wherein the common roller of the pair of registration rollers is moved to contact the other roller of the pair of registration rollers in one of the first sheet conveyance path and the second sheet conveyance path from the first intermediate position in contact with the other roller of the pair of registration roller to the other one of the first sheet conveyance path and the second sheet conveyance path as the downstream sheet conveyance path starts conveying the sheet.

14. The sheet conveyance device as claimed in claim 1, wherein each of two pairs of registration rollers in the first sheet conveyance path and the second sheet conveyance path is contacted by a leading end of the sheet at a nip formed between the pair of the registration rollers as the first skew corrector or the second skew corrector, wherein one of two pairs of the pushing rollers pushes the sheet to the nip formed between the pair of the registration rollers and one of two pairs of the registration rollers conveys a skew corrected sheet to the third conveyance path, wherein one of the pair of registration rollers and one of the pair of pushing rollers are the common rollers, respectively.

15. The sheet conveyance device as claimed in claim 1, further comprising an eccentric cam configured to move the common roller between the first sheet conveyance path and the second sheet conveyance path.

16. The sheet conveyance device as claimed in claim 1, further comprising:

at least one confluence sheet conveyance device disposed on the third conveyance path; and a detector disposed in the vicinity of the confluence sheet conveyance device to detect a leading end of the sheet conveyed from each of the first sheet conveyance path and the second sheet conveyance; and a time deviation correcting device to correct deviation in a sheet arriving time from a prescribed reference time by controlling the confluence sheet conveyance device in accordance with deviation in a sheet arriving time detected.

17. The sheet conveyance device as claimed in claim 16, further comprising:

a guide to guide the sheet conveyed from one of the first sheet conveyance path and the second sheet conveyance path, the first sheet conveyance path merging in the second sheet conveyance path at upstream of the uppermost stream confluence sheet conveyance device, wherein the detector is located between the confluence in which the sheets meet with each other and the uppermost stream confluence sheet conveyance device.

18. The sheet conveyance device as claimed in claim 1, further comprising:

a confluence sheet conveyance device disposed on the third conveyance path;

a lateral deviation detector to detect lateral deviation of the sheet in a direction perpendicular to a sheet conveyance direction; and a position adjuster to move the sheet in a direction perpendicular to the sheet conveyance direction to adjust the position of the sheet in the lateral direction in accordance with detection result of the lateral deviation detector.

19. The sheet conveyance device as claimed in claim 18, wherein the position adjuster comprises the pair of registration rollers that conveys the sheet with the skew being corrected by one of the first skew corrector and the second skew corrector toward the third conveyance path.

20. An image formation apparatus comprising:

an image bearer to bear an image;

an image formation device to form a visual image on the image bearer;

a sheet conveyance device to convey a sheet; and a transfer device to transfer the visual image from the image bearer to a sheet conveyed by the sheet conveyance device, said sheet conveyance device comprising:

a first sheet conveyance roller unit disposed in a first sheet conveyance path to receive and convey a sheet;

a first skew corrector disposed in the first sheet conveyance path to correct skew of the sheet;

a second sheet conveyance roller unit disposed in a second sheet conveyance path to receive and convey a sheet, said a second sheet conveyance path being disposed parallel to the first sheet conveyance path;

a second skew corrector to correct skew of the sheet disposed in the second sheet conveyance path; and a third conveyance path disposed downstream of the first sheet conveyance path and the second sheet conveyance path, into which the first sheet conveyance path and the second sheet conveyance path merge, the sheet being alternately conveyed to the first sheet conveyance path and the second sheet conveyance path, wherein the first sheet conveyance roller unit and the second sheet conveyance roller unit shares a common roller.

* * * * *